US009909596B2

(12) United States Patent
Crawford et al.

(10) Patent No.: US 9,909,596 B2
(45) Date of Patent: Mar. 6, 2018

(54) ICE DEFLECTOR FOR A FAN HOUSING

(71) Applicant: Lennox Industries Inc., Richardson, TX (US)

(72) Inventors: Carl T. Crawford, Hickory Creek, TX (US); Chris McHugh, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 899 days.

(21) Appl. No.: 14/087,535

(22) Filed: Nov. 22, 2013

(65) Prior Publication Data

US 2015/0147161 A1 May 28, 2015

Related U.S. Application Data

(63) Continuation of application No. 14/087,196, filed on Nov. 22, 2013.

(51) Int. Cl.
*F04D 29/70* (2006.01)
*F04D 19/00* (2006.01)
*F04D 29/54* (2006.01)

(52) U.S. Cl.
CPC ..... *F04D 29/703* (2013.01); *F04D 19/002* (2013.01); *F04D 29/545* (2013.01); *Y10T 29/49236* (2015.01)

(58) Field of Classification Search
CPC ..... F04D 29/703; F04D 19/002; F04D 29/545
USPC ..... 415/121.2; 135/115; 454/275, 210, 202, 454/205, 217, 219, 221, 222
See application file for complete search history.

(56) References Cited

U.S. PATENT DOCUMENTS 1,121,542 A * 12/1914 Wegner ..... F24F 7/013 454/205
5,433,661 A * 7/1995 Kim ..... F24F 1/02 454/202
6,464,579 B1 * 10/2002 Salazar ..... F24F 13/065 454/202
7,908,879 B1 * 3/2011 Chen ..... F24F 1/0007 62/259.1
2003/0217563 A1 * 11/2003 Wendt ..... F24F 1/18 62/298
2007/0125593 A1 * 6/2007 Hashizume ..... F04D 29/545 181/225
2008/0170940 A1 * 7/2008 Wu ..... F04D 29/703 415/214.1
2009/0053990 A1 * 2/2009 McKee ..... F24F 7/02 454/250
2009/0317239 A1 12/2009 Xu
2010/0081371 A1 * 4/2010 Dinicolas ..... F24F 13/20 454/275
2010/0319380 A1 * 12/2010 Mochizuki ..... F24F 1/06 62/259.1

(Continued)

FOREIGN PATENT DOCUMENTS

CA 2577154 A1 2/2007
CA 2754514 A1 10/2011
CN 2835859 10/2005

*Primary Examiner* — Aaron R Eastman
(74) *Attorney, Agent, or Firm* — Hubbard Johnston, PLLC

(57) ABSTRACT

In various implementations, a fan system may include a housing and a fan. The fan may reside in an orifice of the housing. The fan system may include a grate disposed proximate a top surface and an ice deflector. The ice deflector may inhibit ice formation on portions of the housing, orifice, and/or fan residing in the orifice.

11 Claims, 5 Drawing Sheets

(56) References Cited

U.S. PATENT DOCUMENTS

2012/0047931 A1* 3/2012 Mangum ..... F25B 49/027
62/186

* cited by examiner

ICE DEFLECTOR FOR A FAN HOUSING

CROSS-REFERENCE TO RELATED APPLICATIONS

This application claims priority to, and is a continuation of, U.S. Non-Provisional patent application Ser. No. 14/087,196, entitled "ICE DEFLECTOR FOR A FAN HOUSING", filed on Nov. 22, 2013, which is hereby incorporated by reference for all purposes.

TECHNICAL FIELD

The present disclosure relates to an ice deflector for a fan housing.

BACKGROUND

Fans are utilized in a wide variety of operations. For example, fans may be utilized in heat pumps, in air conditioning systems, and/or in refrigeration systems. The types of fans utilized in such systems may include mechanical fans, such as axial flow fans and/or cross-flow fans. The fan type and/or size may be selected based on the desired use of the fan.

SUMMARY

In various implementations, a fan system may include a housing with an orifice, a grate, and an ice deflector. A fan may reside in the orifice. The grate may be disposed proximate a top surface of the housing and cover the orifice. The ice deflector may be disposed above the grate and the housing. The ice deflector may inhibit ice formation on portions of the housing, orifice, and/or fan residing in the orifice.

In various implementations, an ice deflector, for a fan system, may include a base and a ring shaped annular protrusion coupled to the base. The base may include one or more sloped portions. The ice deflector may include an opening formed by the annular protrusion. The ice deflector may include coupling member(s) to couple the ice deflector to at least a portion of a fan system. The ice deflector may be removably coupleable to the fan system.

Implementations may include one or more of the following features. A height of the ice deflector may be approximately 2 inches to approximately 3 inches. At least one of the sloped portions of the base slopes approximately 30 degrees to approximately 60 degrees from an axis parallel to a top surface of the annular protrusion. At least one of the coupling members may couple to a grate of the fan system. In some implementations, at least one of the coupling members may couple to a housing of the fan system. At least one of the coupling members may include a clip, in some implementations. The sloped portion(s) of the base may cover at least a portion of one or more flanges of a fan system. The ice deflector may be adapted such that when coupled to at least a portion of the fan system, an IEER rating of the fan system with the ice deflector comprises at least approximately the IEER rating of the fan system without the ice deflector.

In various implementations, an ice deflector may be disposed proximate a grate of a fan system such that the grate is disposed between the ice deflector and an orifice of the fan system. The ice deflector may include a base, which includes one or more sloped portions; an annular protrusion; and an opening formed by the annular protrusion. The opening formed by the annular protrusion may be aligned with an orifice of the fan system. Aligning the opening and the orifice may include disposing the ice deflector such that a center of the opening is disposed on an axis through a center of the orifice. The axis may be approximately perpendicular to an axis parallel to a top surface of the ice deflector. At least a portion of the ice deflector and at least a portion of the fan system may be coupled.

Implementations may include one or more of the following features. Coupling at least a portion of the ice deflector and at least a portion of the fan system may include coupling at least a portion of the ice deflector via one or more coupling members of the ice deflector. Coupling at least a portion of the ice deflector and at least a portion of the fan system may include allowing an exterior surface of a housing of the fan system to be frictionally fit between protrusions of the ice deflector. The protrusions of the ice deflector may extend from the base of the ice deflector. In some implementations, coupling at least a portion of the ice deflector and at least a portion of the fan system may include disposing an exterior surface of a housing of the fan system between protrusions of the ice deflector. The ice deflector may be removed from the fan system by uncoupling at least a portion of the ice deflector from at least a portion of the fan system. In some implementations, access to a fan of the fan system may be allowed. Allowing access may include uncoupling the ice deflector and the fan system, removing the ice deflector from the fan system, and removing the grate from the fan system. Ice accumulation on a flange of the fan system may be inhibited, in some implementations. Ice bridge formation in the fan system may be inhibited, in some implementations.

In various implementations, a ice deflector, for a fan system, may include a base and an annular protrusion coupled to the base. The ice deflector may include an opening formed by the annular protrusion. The ice deflector may be coupled to a fan system and may inhibit ice formation in at least a portion of the fan system, when the ice deflector is coupled to the fan system.

Implementations may include one or more of the following. The base may include a base width greater than or approximately equal to a width of a housing of the fan system, and a base length greater than or approximately equal to a length of the housing of the fan system. The base may cover at least a portion of a flange of the fan system. In some implementations, the opening of the ice deflector may include an opening length approximately similar to an orifice length of the fan system, and an opening width approximately similar to an orifice width of the fan system.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, fan systems are utilized to provide a fluid flow (e.g., air flow) in a variety of applications, such as air conditioning (e.g., heat pump) and/or refrigeration. For example, fan systems may be utilized with outdoor and/or indoor coils in air conditioning systems. The fan systems may be utilized with heat exchangers in refrigeration units.

Fan systems may include a housing with an orifice, a fan disposed at least partially within the orifice, and a motor that drives the fan. The motor may cause blades of the fan to rotate and cause movement of the air proximate the fan blades. Thus, the movement of the fan blades may generate airflow through an opening in the orifice.

In some implementations, fan system, for example as part of an air conditioner, may be allowed to operate in conditions favorable for ice accumulation (e.g., moist and/or cold environment). Ice may accumulate on portions of the fan system (e.g., fan housing, grates, orifice, and/or fan).

Ice accumulation may be reduced, in some implementations, by utilizing the ice deflector. The ice deflector may inhibit precipitation (e.g., rain, sleet, freezing rain, ice) from accumulating on surfaces of the fan housing such as flanges and/or from dripping from flanges into an orifice of the fan system. The reduction of dripping of precipitation down the walls of the orifice of the fan system may inhibit ice bridge formation and/or ice accumulation on various other portions. For example, an ice bridge may form between an inner wall of the orifice and a tip of a fan blade, and the rotation of the fan may inhibit and/or break the ice bridge. One or more defrost operations may be allowed during ice conditions to reduce ice accumulation (e.g., reversing valve may be energized and/or de-energized to heat the outdoor coil).

Figure 1A:
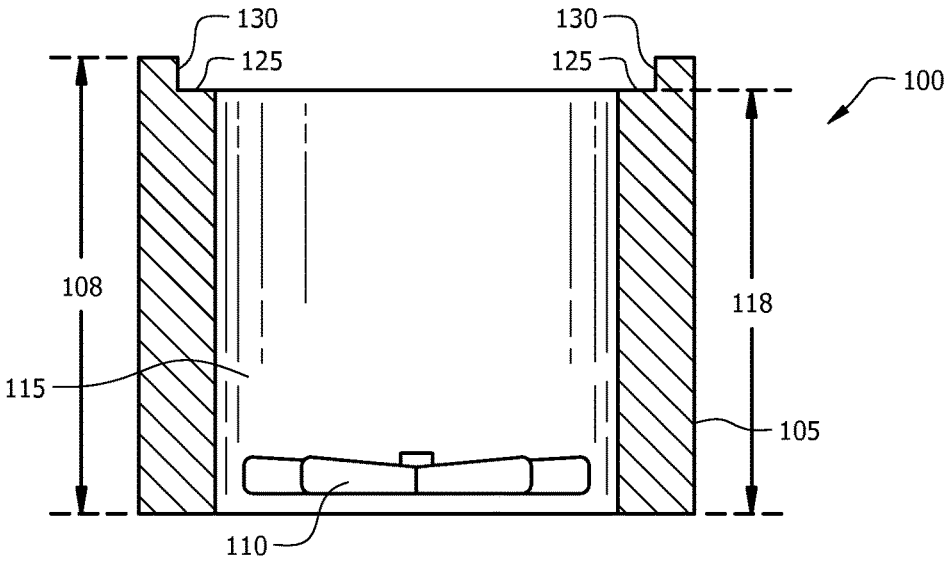
FIG. 1A illustrates a cutaway side view of an implementation of an example portion of a fan system.
Figure 1B:
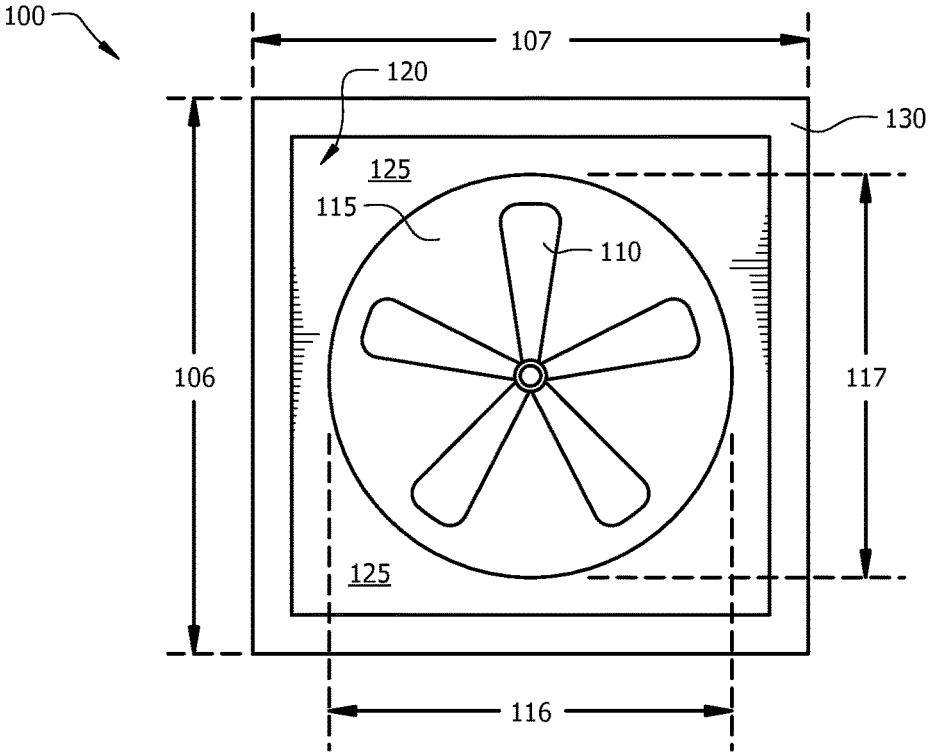
FIG. 1B illustrates a top view of an implementation of the example portion of the fan system illustrated in FIG. 1A.

FIG. 1A illustrates a cutaway side view of an implementation of an example portion 100 of a fan system. FIG. 1B illustrates a top view of an implementation of the example portion 100 of the fan system illustrated in FIG. 1A. As illustrated, the fan system includes a housing 105 and a fan 110. The housing 105 may have a width 106, a length 107, and a height 108. The housing 105 includes an orifice 115. The orifice may have a length 116, a width 117, and a height 118. The fan 110 may be disposed in the orifice 115. The size and/or shape of the housing and/or orifice may be any appropriate size and/or shape.

As illustrated the housing may include a top surface 120. The top surface may include one or more flanges 125. The flanges 125 may be coupled to the orifice 115. A flange 125 may be coupled to the orifice 115 such that if water, ice, etc. accumulates on a flange, it may drip, fall, and/or flow down a wall of the orifice. The top surface may be a recessed portion disposed between protrusion(s) 125 of the housing 105. For example, a recessed portion of the top surface 120 may be adapted to receive a grate. The recessed portion may include the flange(s). In some implementations, the flange(s) may include the corners and sides of the top surface that form the recessed portion.

Figure 2A:
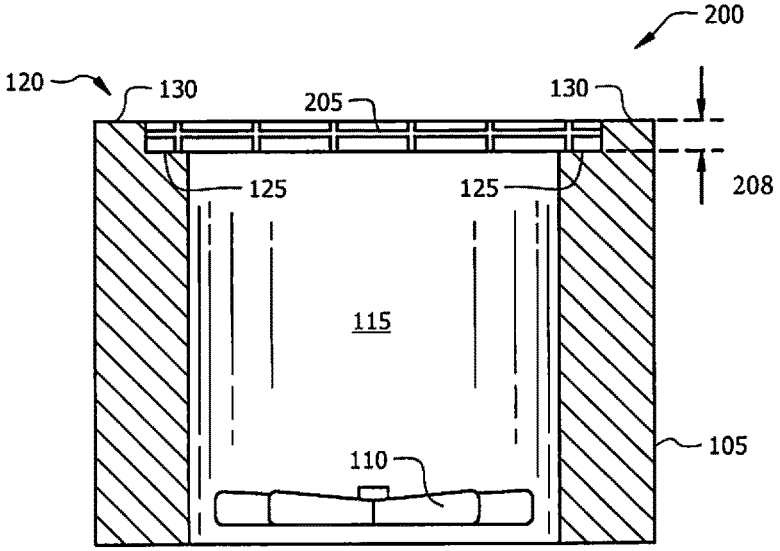
FIG. 2A illustrates a cutaway side view of an implementation of an example portion a fan system.
Figure 2B:
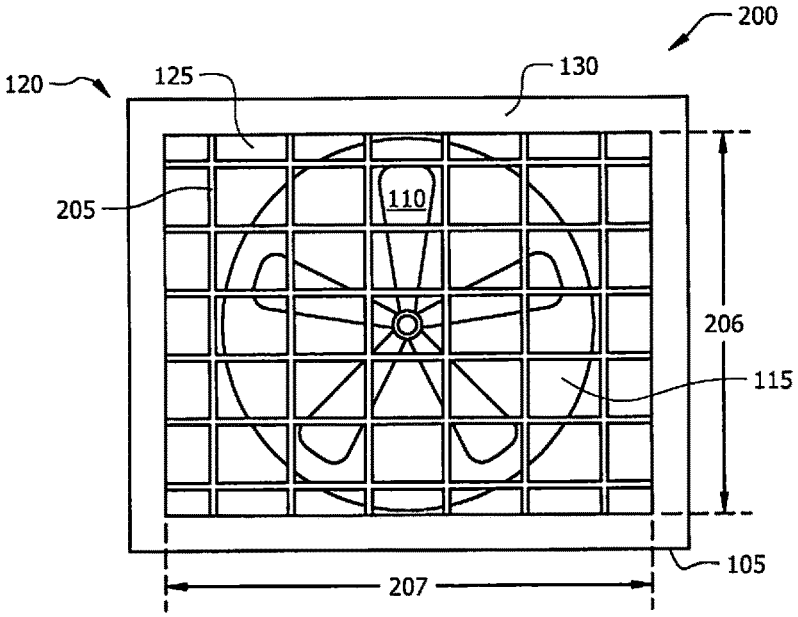
FIG. 2B illustrates a top view of an implementation of the example portion of the fan system illustrated in FIG. 2A.

FIG. 2A illustrates a cutaway side view of an implementation of an example portion 200 of a fan system with a grate. FIG. 2B illustrates a top view of an implementation of the example portion 200 of the fan system illustrated in FIG. 2A. As illustrated, a grate 205 may be disposed proximate a top surface 120 of the housing. The grate 205 may have a width 206, a length 207, and a height 208. The height 208 of the grate may be approximately similar to a height of a protrusion. The width 206 of the grate may be greater than an orifice width 116 and/or less than a width 106 of the housing. The length 208 of the grate may be greater than an orifice length 117 and/or less than a length 107 of the housing. For example, the grate may reside in the recessed portion of the top surface and/or rest on the flanges 125 of the top surface 120 of the housing 105.

In some implementations, the grate may be coupled (e.g., via coupling members such as bolts and/or screws) to the housing. For example, the flange may include an opening and a grate may include an opening and a coupling member such as a bolt may be disposed at least partially through the openings to couple the grate and the housing.

Figure 3A:
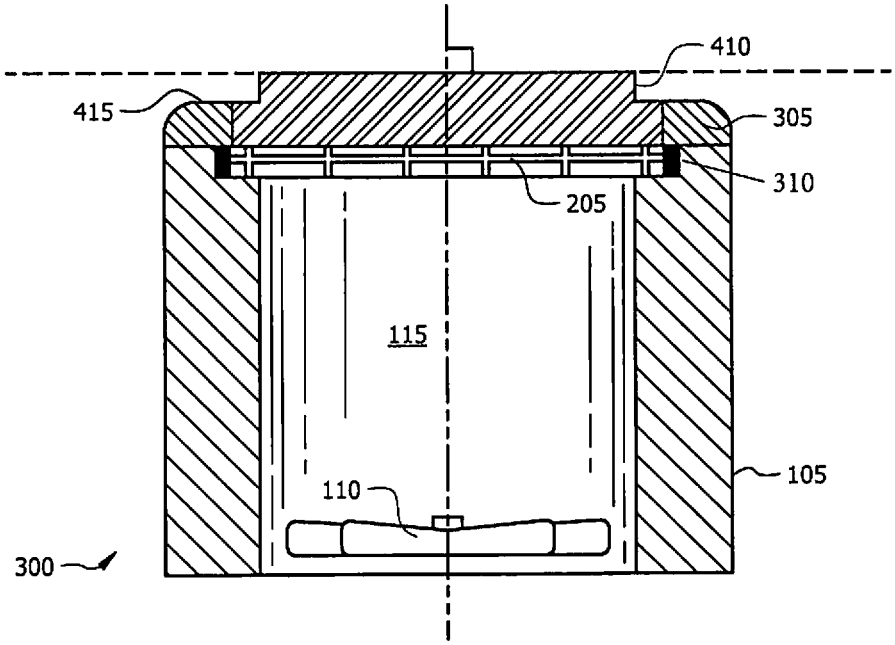
FIG. 3A illustrates a cutaway side view of an implementation of an example portion a fan system.
Figure 3B:
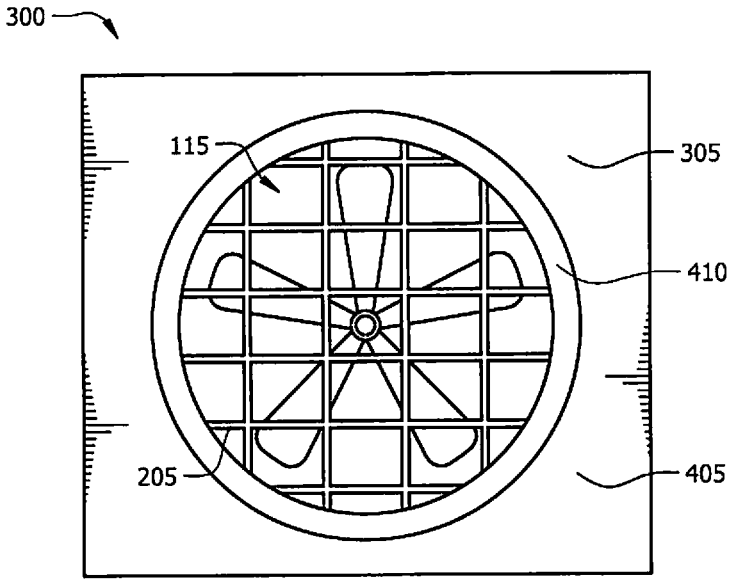
FIG. 3B illustrates a top view of an implementation of the example portion of the fan system illustrated in FIG. 3A.

The fan system may include an ice deflector to inhibit ice formation on portions of the fan system. FIG. 3A illustrates a cutaway side view of an implementation of an example fan system 300 with an ice deflector. FIG. 3B illustrates a top view of an implementation of the fan system 300 illustrated in FIG. 3A. As illustrated, the fan system 300 includes an ice deflector 305 coupled to at least a portion of the of the fan system. The ice deflector 305 may be disposed above a top surface 120 of the housing 105 such that the grate 205 is disposed between at least a portion of the orifice 115 housing 105 and at least a portion of the ice deflector 305.

Figure 4A:
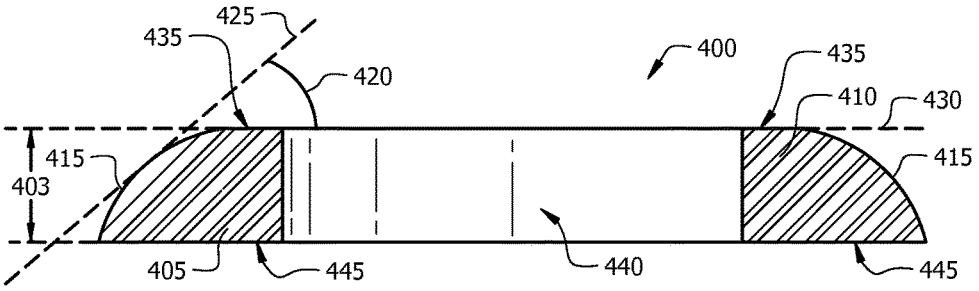
FIG. 4A illustrates a cutaway side view of an implementation of an example portion an ice deflector.
Figure 4B:
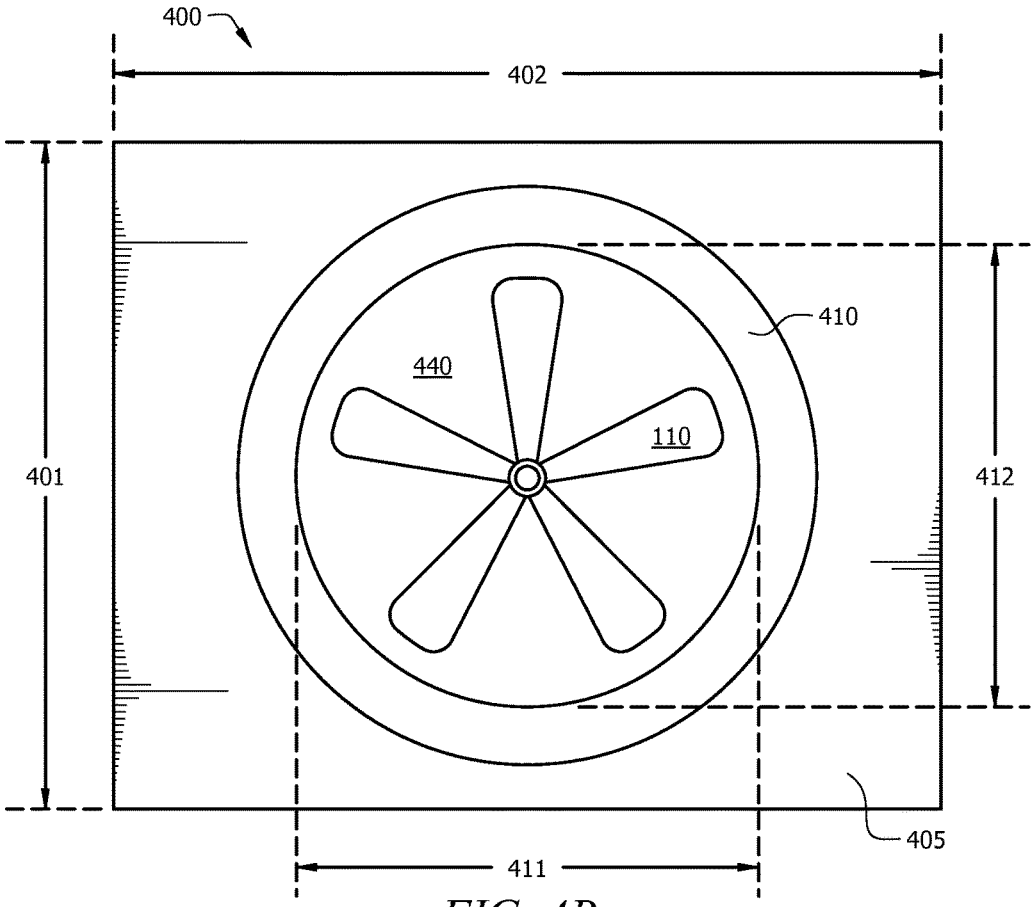
FIG. 4B illustrates a top view of an implementation of the example portion of the ice deflector illustrated in FIG. 4A.

FIG. 4A illustrates a cutaway side view of an implementation of an example ice deflector 400. FIG. 4B illustrates a top view of an implementation of the example ice deflector 400 illustrated in FIG. 4A. As illustrated, the ice deflector 400 includes a width 401, a length 402, and a height 403. The width 401 of the ice deflector 400 may be approximately similar to a width 106 of a housing 105 and/or a width 206 of a grate 205. The length 402 of the ice deflector 400 may be approximately similar to the length 107 of the housing 105 and/or a length of a grate 205. The height of the ice deflector 400 may be approximately 2 inches to approximately 3 inches, in some implementations.

As illustrated, the ice deflector 400 includes a base 405 and an annular protrusion 410. The base may include sloped portions 415. For example, at least a portion of the base 405 may slope as the base extends radially from the annular protrusion 410. In some implementations, the sloped portion may extend from a top surface of the annular protrusion to the edge(s) of the base. The sloped portion 415 may be sloped at an angle 420. The angle 420 may be the angle formed between a first axis 425 parallel to the sloped portion and a second axis 430 parallel to a top surface of the ice deflector. At least a portion of the sloped portion 415 may be slanted and/or curved. The angle may be approximately 30 degrees to approximately 60 degrees.

In some implementations, at least a portion of the base (e.g., sloped portions) may cover at least a portion of the flanges 125 of the top surface 120 of the housing 105. By covering the flanges 125, ice and/or other precipitation may be inhibited from accumulating on the flanges of the housing. By inhibiting precipitation, such as ice from accumulating and/or dripping down into the orifice of the fan system, ice accumulation in the fan orifice and/or the fan may be inhibited. Inhibiting ice accumulation in the fan orifice and/or fan (e.g., blades of the fan) may inhibit wear on components, inhibit ice bridge formation, and/or increase user satisfaction (e.g., since fan may continue operation during an ice storm and/or since fan longevity may be maintained by inhibiting wear on components).

The annular protrusion 410 may be coupled to the base 405. The annular protrusion 410 may include any shape and/or size as appropriate. For example, the annular protrusion may be ring shaped. The inner surface of the annular protrusion 410 may have a width 411, a length 412, and a height. The annular protrusion 410 may have a width 411 that is less than or approximately similar to an orifice width 116. The annular protrusion 410 may have a length 412 that is less than or approximately similar to the orifice length 117. In some implementations, the annular protrusion 410 may have a shape and/or size similar to the orifice of the fan. Thus, an efficiency rating (e.g., IEER, integrated energy efficiency ratio; EER, energy efficiency ratio; SEER, seasonal energy efficiency ratio; and/or COP, coefficient of performance) may be maintained (e.g., when compared to the fan without the ice deflector).

An opening 440 may be formed by the annular protrusion 410 in the base 405 of the ice deflector 400. The opening 440 may have smaller or similar cross-sectional dimensions as the orifice of the housing 105 (e.g., width and/or length). For example, by allowing the opening cross-sectional dimensions to be smaller than or similar to the cross-sectional dimensions of the orifice (e.g., an inner surface of the orifice), precipitation may be inhibited from traveling down an inner wall of the annular protrusion to the flange and then to the inner wall of the orifice. When the annular protrusion and/or opening includes cross-sectional dimensions (e.g., width and/or length) that are smaller or similar to the cross-sectional dimensions (e.g., width and/or length) of the orifice (e.g., an inner surface of the orifice), precipitation may be allowed to fall into the orifice and strike a fan blade during operation. By allowing at least a portion of the precipitation to strike a fan blade, ice accumulation may be inhibited.

The ice deflector 400 may include a bottom surface 445 opposing to the top surface 435. The bottom surface 445 may be at least partially planar. The bottom surface may rest on the top surface of the grate 205.

Figure 4C:
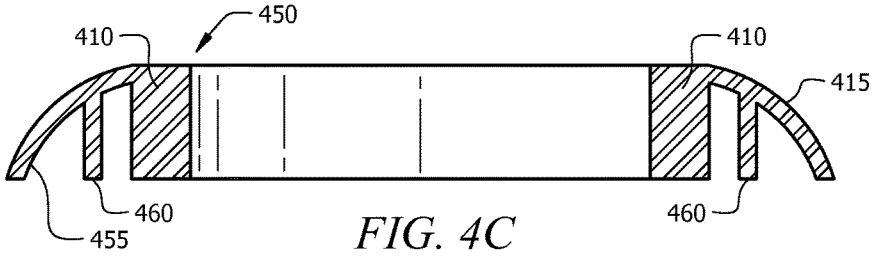
FIG. 4C illustrates a cutaway side view of an implementation of an example portion an ice deflector.

In some implementations, the bottom surface may include curved portions. FIG. 4C illustrates a cutaway side view of an implementation of an example ice deflector 450 with a curved bottom surface 455. As illustrated, coupling members 460 may be coupled to at least a portion of the bottom portion 455. The annular protrusion 410 may extend past a coupling point with a base such that a bottom surface of the annular protrusion may rest on a grate surface during use.

As illustrated in FIG. 3A the ice deflector may include coupling members 310. The coupling members 310 may allow the ice deflector to be coupled to at least a portion of the housing 105 of the fan system. As illustrated, a coupling member 310 of an ice deflector 305 may couple the ice deflector to a grate 205 of the fan system. For example, the coupling member may include a clip that can removably couple with the grate. The coupling member may allow the ice deflector to be snapped into place and unsnapped for removal.

In some implementations, the housing 105 of the fan system may include coupling members to facilitate coupling the ice deflector to the housing. For example, the housing may include a recess adapted to receive a protrusion or clip of the ice deflector. The housing may include an opening and/or the ice deflector may include an opening and a fastener may be disposed through the opening(s) to couple the housing and the ice deflector. For example, a fastener may be disposed through an opening of the ice deflector and contact a surface of the housing to retain the ice deflector. In some implementations, a fastener, such as a bolt, may be disposed through an opening in the ice deflector and an opening in the housing and retained with a threaded nut.

Figure 5A:
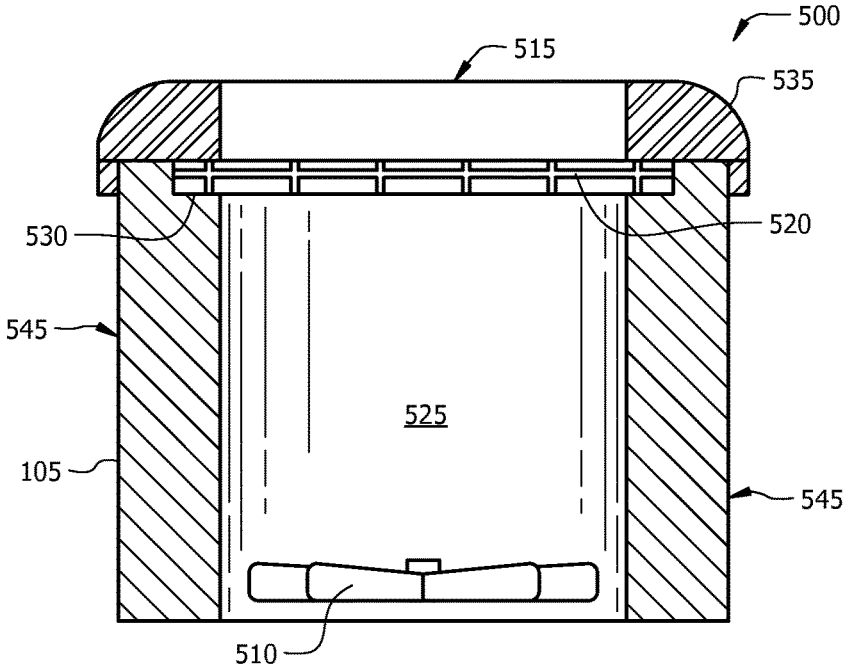
FIG. 5A illustrates a cutaway side view of an implementation of an example portion a fan system.
Figure 5B:
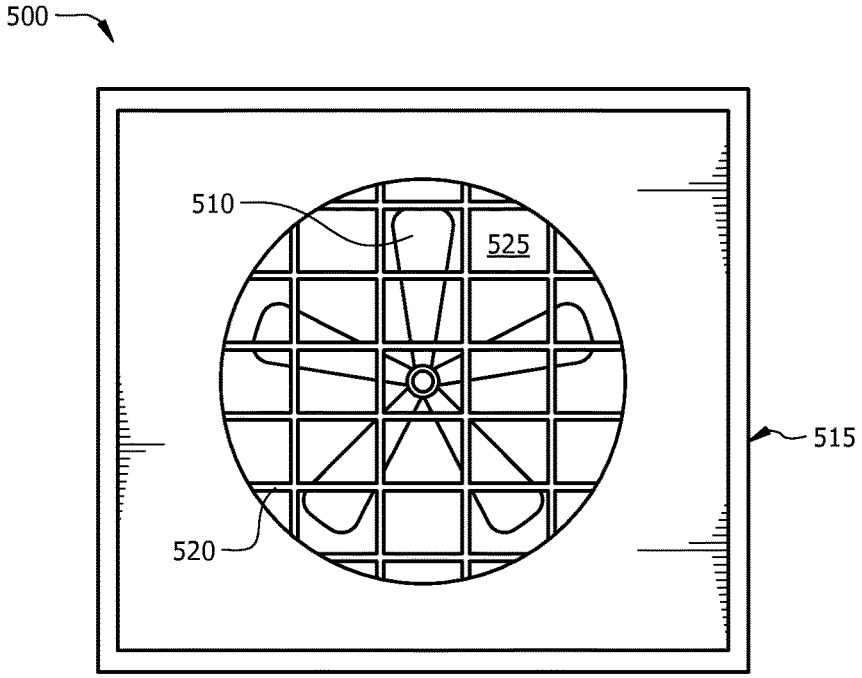
FIG. 5B illustrates a top view of an implementation of the example portion of the fan system illustrated in FIG. 5A.

In some implementations, the ice deflector may include protrusions that facilitate placement and/or retention of the ice deflector on the housing of the fan system. FIG. 5A illustrates a cutaway side view of an implementation of an example fan system 500. FIG. 5B illustrates a top view of an implementation of the example fan system 500 illustrated in FIG. 5A. As illustrated, the fan system 500 includes a fan housing 505, a fan 510, and an ice deflector 515. A grate 520 may be disposed between at least a portion of the ice deflector 515 and the fan 510. The fan 510 may be disposed in an orifice 525 of the housing 505.

As illustrated, the grate 520 may be disposed in a recessed portion 530 of a top surface of the housing. The grate 520 may rest and/or be coupled with the housing 505. The ice deflector 515 may be disposed such that it rests and/or at least partially contacts the grate 520. In some implementations, a gap or clearance may exist between the ice deflector 515 and the grate 520. At least a portion of the grate 520 may be covered by at least a portion of the base 535 of the ice deflector 515. The base 535 of the ice deflector 515 may cover one or more of the flanges or portions thereof in the recessed portion 530 of the housing. Covering at least a portion of one or more of the flanges may inhibit icing (e.g., when compared with using a fan system without an ice deflector). By at least partially covering a flange, ice accumulation on the flange may be inhibited and/or allowing precipitation to flow from the flange down the inner wall of the orifice may be inhibited (e.g., since the base may shield the flange from precipitation).

The sloped portions of the base 535 may direct fluid flow (e.g., precipitation) away from the annular protrusion and/or orifice. The sloped portions of the base 535 may direct fluid flow towards exterior surfaces 540 of the housing.

As illustrated, in some implementations, the ice deflector 515 may include protrusions 545. The protrusions 545 may be coupled to the base of the ice deflector. The protrusions 545 may extend from the base and form a recessed portion in a bottom surface of the ice deflector 515. A housing 105 of the fan system 500 may be disposed in the recessed portion of the base 535. For example, the housing 505 may be at least partially disposed between the protrusions of the ice deflector. In some implementations, the protrusions may form a second annular ring on an opposing side of the ice deflector and the housing may be disposed in the second annular ring. The size and/or shape of the recessed portion formed by the protrusions 545 (e.g., second annular ring) may be selected based on the size and/or shape of the exterior of the housing. For example, the size and/or shape of the ice deflector may be selected such that the width and length of the base is greater than a width and a length of the housing.

In some implementations, the protrusions of the ice deflector may include a coupling member. For example, the protrusion(s) may include openings through which a fastener may be disposed to couple the ice deflector to the housing (e.g., by disposing the fastener in an opening in the housing and/or by contacting the housing with an end of a fastener to retain the ice deflector on the housing).

In some implementations, the ice deflector may include installation guides to guide proper positioning of the annular protrusion above the orifice. For example, the installation guide may be a protrusion adapted to extend in an opposing direction as the annular protrusion and be disposed in the office. During installation, a user may position the installation guide(s) in the orifice to ensure proper positioning. For example, two opposing protrusions may be spaced such that at least one may contact an inner surface of the orifice. In some implementations, the installation guides may include recesses (e.g., grooves) in the housing. During installation, a user may position the edges of the ice deflector in the installation guides to ensure proper positioning.

In some implementations, the ice deflection may include installation guides, such as openings (e.g., an opening proximate each corner of the ice deflector). The housing may include openings that align with the openings in the ice deflector, when properly positioned. A fastener (e.g., screw) may be disposed at least partially through the openings in the ice deflector and openings of the housing to ensure proper positioning.

In some implementations, the ice deflector may be removably coupled to the housing and/or grate of the fan system.

The ice deflector may be installed at a factory and/or field installed (e.g., by a field technician and/or by a homeowner on a fan of an air conditioner). For example, a fan system may be coupled with an ice deflector prior to installation at a site. In some implementations, a user may snap on an ice deflector to an existing fan system. For example, a retrofit kit may be available for existing fan systems.

A retrofit kit may include an ice deflector and/or fasteners. For example, the retrofit kit may include an ice deflector that is coupleable to a range of sizes of existing fan systems (e.g., exterior housing sizes and/or interior orifice size). The user may select the appropriate retrofit kit and couple the ice deflector to a grate of the fan system, for example with fasteners, such as clips. In some implementations, the retrofit kit may include an ice deflector with a base that includes an expandable portion. The expandable portion may allow the ice deflector to expand to cover a wider range of fan system sizes. For example, the expandable portion may include an accordion folded plastic. The accordion folded plastic of the base may expand to fit the exterior of a user's fan system housing. The base may include protrusions and the housing may be disposed between the protrusions. By utilizing an expandable portion, the ice deflector may be selected for orifice size and stretched or contracted to fit a range of housing sizes.

In various implementations, an ice deflector may be disposed proximate a grate of a fan system. The ice deflector may be disposed such that a grate of the fan system may be disposed between the ice deflector and a fan and/or at least a portion of the orifice of the fan system.

The opening formed by the annular protrusion of the ice deflector may be positioned. For example, the opening may be aligned with the orifice of the fan system. In some implementations, a center of the opening and the center of the orifice may be disposed on the same first axis. The first axis may be approximately perpendicular to a top surface of the ice deflector.

At least a portion of the ice deflector may be coupled to at least a portion of the fan system. For example, the ice deflector and/or the housing may include coupling members. In some implementations, the ice deflector and the housing may be coupled using a hinged coupler. For example, the ice deflector and the housing may include coupling members that when aligned and secured with a fastener form a hinge. The ice deflector may then be rotated up along the rotation of the hinge to allow access to the orifice. The grate may be removed from the housing prior to accessing the orifice and/or fan. The ice deflector may include a clip that fastens to the grate, in some implementations. In some implementations, the air conditioner may include a recess in which at least a portion of the ice deflector (e.g., a protrusion of the ice deflector) may be retained. The exterior surface of the housing may be frictionally fit between protrusions that extend from a base of the ice deflector.

Ice accumulation may be inhibited from forming on at least a portion of the fan system. For example, ice accumulation may be inhibited from forming on at least a portion of the flange, grate, orifice, and/or fan by coupling the ice deflector and the fan system. In some implementations, ice bridge formation may be inhibited by allowing the ice deflector to be coupled to the fan system.

The ice deflector may be removed from the fan system. The ice deflector and the fan system may be uncoupled and/or the ice deflector may be removed, in some implementations. For example, the ice deflector may be unsnapped from a grate and/or unscrewed from a housing of the fan system.

Once the ice deflector has been removed, access to the grate, orifice, and/or fan may be allowed (e.g., for maintenance; for problem solving; since the probability of icing events has been reduced below a predetermined level, such as in the summer; and/or for any other appropriate purpose). For example, to allow access to the fan, the ice deflector may be removed and then the grate may be removed. Thus, a user may access the orifice and/or the fan.

In some implementations, during use of a fan system with an ice deflector, an efficiency rating may be maintained (e.g., a reduction in efficiency, such as IEER, may be inhibited).

Although FIGS. 1A-5B illustrate various implementations of fan systems, features from systems such as system 100 may be combined with the one or more of the features from other systems, such as system 200, 300, 400, 450, and/or 500. In addition, various features may be added, deleted, and/or modified. For example, other implementations of housings and/or grates may be utilized. For example, an orifice of a housing may be oval. In some implementations, the grates may include other types of appropriate grate shapes and/or patterns of intersection. In some implementations, the housing may be oriented differently. For example, the housing may be disposed on its side and the top surface of the ice deflector may be oriented vertically.

In various implementations, portions of the fan system may be coupled. For example, the motor may be coupled to the fan. The fan may be disposed and/or coupled at least partially in the orifice at one or more predetermined positions.

The fan system may be coupled to at least a portion of an air conditioner (e.g., in a housing of an outdoor coil). The air conditioner may be allowed to operate utilizing the fan system.

Although fan systems in heat pump air conditioning systems have been described, the fan systems may be utilized in other appropriate applications, such as other air conditioning systems and/or refrigeration systems.

Although certain fan shapes are illustrated, other fan shapes and/or configurations may be utilized as appropriate.

In various implementations, references to a top, a side, and/or a bottom are to indicate relative locations and not orientation in an application. For example, the top surface of the fan system may be oriented in a sideways manner in a heat pump. In some implementations, the bottom surface of the fan may be oriented towards the top of a unit containing the fan system.

It is to be understood that the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "fan" includes a combination of two or more fans and reference to "grate" includes different types and/or combinations of grates. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method comprising:

disposing an ice deflector proximate a grate of a fan system such that the grate is disposed between the ice deflector and an orifice of the fan system, and wherein the ice deflector comprises:

a base having one or more sloped portions;

an annular protrusion; and an opening formed by the annular protrusion;

aligning the opening formed by the annular protrusion with an orifice of the fan system;

coupling the ice deflector to the grate with a first plurality of coupling members; and coupling at least a portion of the ice deflector and at least a portion of a housing of the fan system with a second plurality of coupling members;

wherein the ice deflector is configured to direct precipitation away from a surface of the fan system.

2. The method of claim 1, wherein coupling at least a portion of the ice deflector and at least a portion of the of the housing of the fan system comprises allowing an exterior surface of a housing of the fan system to be frictionally fit between protrusions of the ice deflector, wherein the protrusions of the ice deflector extend from the base of the ice deflector.

3. The method of claim 1, wherein coupling at least a portion of the ice deflector and at least a portion of the housing of the fan system comprises disposing an exterior surface of a housing of the fan system between protrusions of the ice deflector, wherein the protrusions of the ice deflector extend from the base of the ice deflector.

4. A method of claim 1, further comprising removing the ice deflector from the fan system by uncoupling at least a portion of the ice deflector from at least a portion of the fan system.

5. The method of claim 1, further comprising allowing access to a fan of the fan system, wherein allowing access comprises:

uncoupling the ice deflector and the fan system;

removing the ice deflector from the fan system; and removing the grate from the fan system.

6. The method of claim 1, further comprising inhibiting ice accumulation on a flange of the fan system.

7. The method of claim 1, further comprising inhibiting ice bridge formation in the fan system.

8. An ice deflector for a fan system comprising:

a base;

an annular protrusion coupled to the base;

an opening formed by the annular protrusion;

a first plurality of coupling members operable to couple the ice deflector to a grate disposed between the ice deflector and a housing of the fan system; and a second plurality of coupling members operable to couple the ice deflector to the housing of the fan system;

wherein the ice deflector is adapted to be coupled to a fan system and wherein the ice deflector is adapted to inhibit ice formation in at least a portion of the fan system when the ice deflector is coupled to the fan system.

9. The ice deflector of claim 8, wherein the base comprises:

a base width greater than or equal to a width of a housing of the fan system; and a base length greater than or equal to a length of the housing of the fan system.

10. The ice deflector of claim 8, wherein the base is adapted to cover at least a portion of a flange of the fan system.

11. The ice deflector of claim 8, wherein the opening of the ice deflector comprises:

an opening length less than an orifice length of the fan system; and an opening width less than an orifice width of the fan system.

* * * * *